United States Patent [19]

Schoen et al.

[11] Patent Number: 4,478,468

[45] Date of Patent: Oct. 23, 1984

[54] LINE-GATED SWITCHING POWER SUPPLY

[75] Inventors: Erich W. Schoen, Glen Ellyn; Lee D. Tice, Bartlett, both of Ill.

[73] Assignee: Pittway Corporation, Aurora, Ill.

[21] Appl. No.: 412,156

[22] Filed: Aug. 27, 1982

[51] Int. Cl.[3] ..... G05F 1/00; H05B 37/00

[52] U.S. Cl. ..... 315/291; 315/194; 315/199; 315/200 R; 315/307; 315/DIG. 4

[58] Field of Search ..... 315/291, 194, DIG. 4, 315/199, 307

[56] References Cited

U.S. PATENT DOCUMENTS

| | | | |
|---|---|---|---|
| 3,103,618 | 9/1963 | Slater | 315/DIG. 4 |
| 3,731,182 | 5/1973 | Hironi et al. | 315/307 |
| 3,898,553 | 8/1975 | Van Boggett | 315/200 A |
| 3,935,505 | 1/1976 | Spiteri | 315/DIG. 4 |
| 4,250,432 | 2/1981 | Kohler | 315/291 |

*Primary Examiner*—Harold Dixon
*Attorney, Agent, or Firm*—Emrich & Dithmar

[57] ABSTRACT

A lamp dimming module includes a lamp receptacle in series with a triac across the AC line, and a power supply for a processing unit, the processing unit supplying firing signals for the triac to control the dimming. The module plugs into the AC line. The power supply is connected in series with the lamp receptacle and in parallel with the triac, and includes cascaded transistors coupled to the AC line for providing charging current to a capacitor. Drive current is provided at the base of one of the transistors through a current-limiting resistor to drive the transistors into saturation for passing maximum current to the capacitor when the triac is open-circuited. A Zener diode is connected to the transistor base and breaks down when the capacitor is fully charged to provide a gating current to an SCR which drains the base drive from the transistor, shutting it off.

7 Claims, 3 Drawing Figures

LINE-GATED SWITCHING POWER SUPPLY

BACKGROUND OF THE INVENTION

The present invention relates to power supplies for providing DC voltage from an AC source. More particularly, the invention relates to a power supply which is suitable for use in a lamp dimming module of the type which is used in microprocessor-based appliance and lamp control systems.

Regulated power supplies are fundamentally of two basic types, viz., analog or pass type and switching type. Examples of both types may be found in "Voltage Regulator Handbook", published by National Semiconductor Company, pages 7-3 and 7-4 (1980). The pass device supply provides DC current as requested by the load, and the switching type supply essentially switches between full on and full off conditions for varying times. However, both types of power supply can be operated at only a single AC input frequency, and the circuitry must be modified to accommodate use with a different frequency AC source. Even more importantly, neither type of power supply can operate with an intermittent AC source, i.e., one wherein the AC voltage is present for only a portion of each cycle of the AC wave.

This latter requirement is of particular importance in lamp dimming applications. An appliance control system which utilizes lamp dimming modules is disclosed in U.S. application Ser. No. 271,244 filed June 8, 1981, and assigned to the assignee of the present invention. Such a system includes a central control unit and a plurality of slave units each including a microprocessor and respectively plugged into outlet sockets of an AC line. Lamps or other appliances are respectively coupled to the slave units. Among other functions which can be performed by such a system, lamps plugged into remote slave units can, under remote control from the central control unit, be turned on or off or dimmed to any desired degree of brightness. The slave units of that system are so arranged that the lamp is connected in parallel with the slave modules so that the AC line voltage is always present at the module terminals, regardless of the condition of the lamp.

However, it has been found desirable in certain applications to arrange the slave units so that the lamp is connected in series with the module, one such application being where the slave unit is wired directly to the AC line in place of a wall switch control for the lamp. The slave unit typically includes a triac-type dimming circuit wherein the triac is fired into conduction by the microprocessor at a predetermined point during each half cycle of the AC voltage waveform, the triac remaining conductive for closing the lamp circuit for the remainder of that half cycle. The brightness of the lamp is determined by the proportion of each half cycle that the triac is conductive. When the triac is conductive and the lamp is on, virtually the entire AC voltage drop is across the lamp and substantially no AC voltage is available to the microprocessor power supply in the slave unit. The standard types of power supply will not operate properly when the AC source voltage is collapsed in mid-cycle in this manner.

SUMMARY OF THE INVENTION

The present invention relates to an improved power supply which avoids the disadvantages of prior power supplies while affording additional structural and operating advantages.

It is a general object of this invention to provide a power supply which will operate whether the AC source is continuous or intermittent, i.e., removed for a portion of each AC cycle.

It is another object of this invention to provide a power supply of the type set forth which can effectively supply a varying load while having the relatively high efficiency of a switching-type regulator supply.

It is still another object of this invention to provide a power supply of the type set forth, which is operable with any frequency AC source.

Yet another object of the invention is the provision of a power supply of the type set forth which is characterized by small size and minimal heat generation.

Another object of this invention is the provision of a microprocessor-controlled lamp dimming circuit incorporating a power supply of the type set forth.

These and other objects of the invention are attained by providing a line gated switching power supply capable of operation with an interrupted AC source, the power supply comprising a charge storage device adapted to be connected across an associated load, current valve means connected in circuit between the associated AC source and the charge storage device and adapted for operation between an open-circuit condition and a maximum-conduction condition for passing maximum current to the charge storage device for charging same, means for providing a control current to the current valve means sufficient to operate the current valve means in its maximum-conduction condition, and control means coupled to the current valve means and responsive when the voltage across the charge storage device exceeds a predetermined level for removing the control current from the current valve means thereby to cause the current valve means to shift to its open-circuit condition and terminate current flow to the charge storage device.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
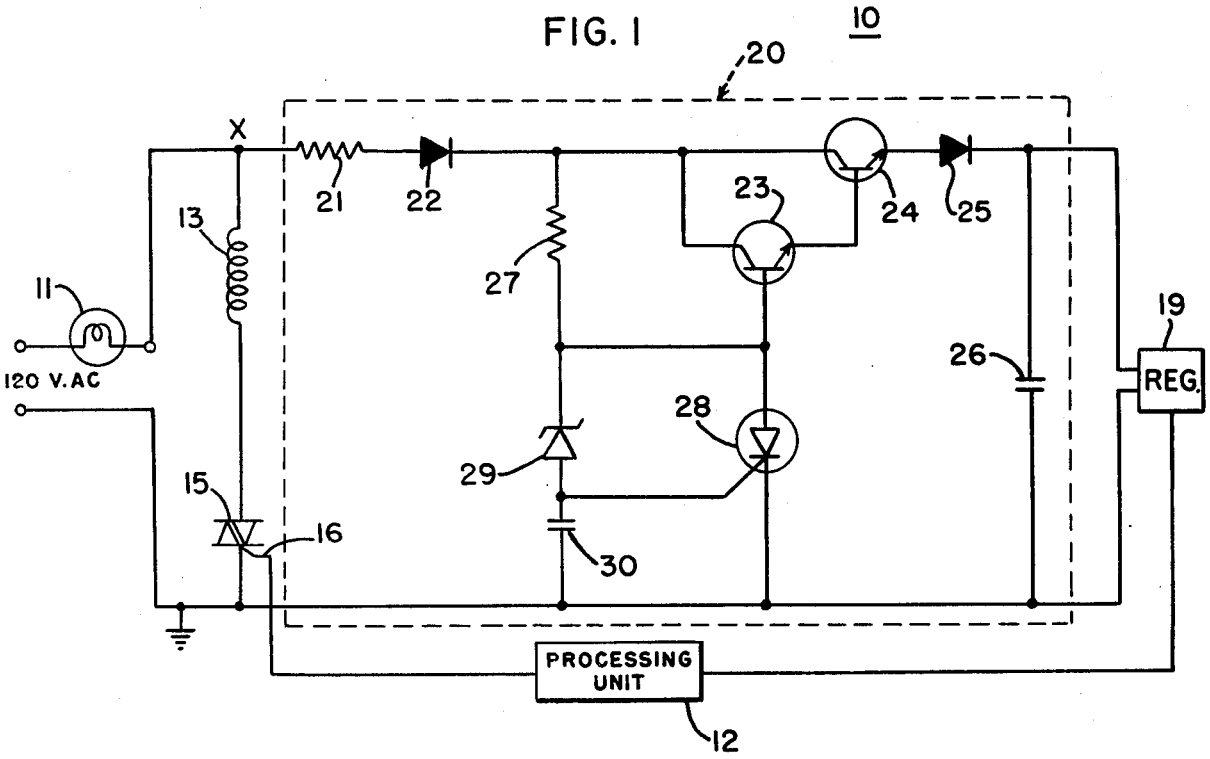
FIG. 1 is a partially block and partially schematic circuit diagram of a lamp dimming module incorporating a power supply constructed in accordance with and embodying the features of the present invention.

Referring to FIG. 1, there is illustrated a control module, generally designated by the numeral 10, of the type which is adapted to be wired directly in series with a lamp 11, such as a ceiling-mounted lamp fixture, for controlling the lamp. The module 10 is of the general type of slave unit used in control systems such as the one disclosed in the aforementioned U.S. application Ser. No. 267,244, and in particular is the type of slave unit which may be wired in place of a wall switch controlling the lamp 11. In such a system the slave unit and a central control unit are both connected to the AC line at remote points in a building and the lamp is connected to the slave module. The lamp can then be remotely controlled from the central control unit by communication over the AC power lines, for turning the lamp on or off or dimming or brightening it.

The module 10 includes a processing unit 12 which typically includes a microprocessor.

Connected in series across the hot and neutral wires of the AC line are the socket for the lamp 11, a choke 13 and a triac 15. The triac 15 has a control terminal 16 which is connected to the processing unit 12. Connected in parallel with the triac 16 is a power supply circuit, generally designated by the numeral 20, constructed in accordance with and embodying the features of the present invention. The output of the power supply circuit 20 is applied through a regulator 19 to the processing unit 11.

Figure 2A:
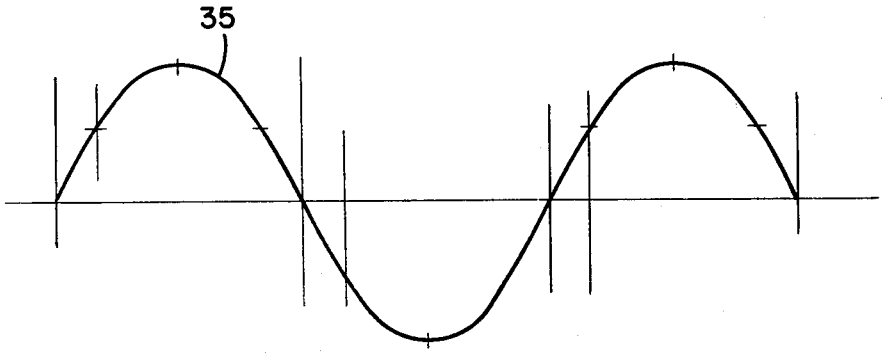
FIGS. 2A and 2B are wave form diagrams respectively depicting the voltage at terminal X in the circuit of FIG. 1 when the lamp is off and when it is operating at its maximum brightness condition.

The power supply circuit 20 is connected in series with the lamp 11 and its impedance is such that, when the triac 15 is non-conductive so that the lamp 11 is off, there will be very little voltage drop across the lamp 11 and virtually the entire AC source voltage will be available to the power supply circuit 20 at terminal X. The voltage at terminal X in this condition is illustrated by the curve 35 in FIG. 2A. However, when the lamp 11 is on by reason of the triac 15 having been fired into conduction, the triac 15 will short out the power supply circuit 20 and, therefore, virtually the entire AC source voltage will be dropped across the lamp 11. The voltage at the terminal X in this condition is illustrated by the wave form 36 in FIG. 2B. In this example, the triac 15 fires into conduction 30° after each zero crossing of the AC source waveform. Thus, the AC source voltage is available at terminal X for the first 30° of each half cycle, and for the remainder of each half cycle the voltage at terminal X is essentially zero. It will be assumed that in the example illustrated in FIG. 2B, the lamp 11 is at or near its maximum intensity condition. The later during each half cycle that the triac 15 is fired into conduction, the less intense will be the light from the lamp 11.

Referring now more particularly to the power supply circuit 20, there is connected in series between the terminal X and the neutral AC line a resistor 21, a diode 22, cascaded transistors 23 and 24 arranged in a Darlington configuration, a diode 25 and a capacitor 26. The regulator 19 is connected across the capacitor 26. The cathode of the diode 22 is connected to the collectors of the resistors 23 and 24. The emitter of the transistor 23 is connected to the base of the transistor 24 and the emitter of the transistor 24 is connected to the anode of the diode 25. Connected across the collector-base junction of the transistor 23 is a current-limiting resistor 27. The base of the transistor 23 is also connected to the anode of an SCR 28, the cathode of which is connected to the neutral AC line. A Zener diode 29 has its cathode connected to the base of the transistor 23 and its anode connected to the gate terminal of the SCR 28. A capacitor 30 is connected between the gate terminal and the neutral AC line.

In operation, as the AC voltage at terminal X rises from zero, current flows through the resistor 21 and the diode 22. At this point the current divides, and some goes through the resistor 27 to provide a base drive current for the transistor 23. The voltage at the base of the transistor 23 is the sum of the voltage on the capacitor 26, the drop across the diode 25, the base-emitter voltage of the transistor 24 and the base-emitter voltage of the transistor 23, the latter three voltages each being approximately 0.6 volts. Thus, the voltage at the base of the transistor 23 is approximately 1.8 volts plus the voltage on the capacitor 26. The current through the resistor 27 cannot flow through the Zener diode 29 until the voltage at the base of the transistor 23 exceeds the breakdown voltage of the Zener diode 29. Thus, for purposes of illustration, if the Zener diode 29 has a breakdown voltage of 24 volts, the current cannot flow through the Zener diode 29 until the voltage on the capacitor 26 reaches 22.6 volts, which is designed to be substantially the full-charge voltage of the capacitor 26. Therefore, assuming the capacitor 26 is not fully charged, the current through the resistor 27 drives the transistor 23 into saturation, which in turn drives the transistor 24 into saturation. This allows the transistor 24 to pass a high current through the diode 25 to the capacitor 26.

Eventually, the capacitor 26 charges to its full-charge voltage (assumed to be 22.6 volts in this case), which allows the base of the transistor 23 to rise above the breakdown voltage of the Zener diode 29. As this occurs, the Zener diode 29 begins to conduct and pass a current into the gate electrode of the SCR 28, firing it into conduction. Conduction of the SCR 28 steals all of the current through the resistor 27, thus removing the base drive from the transistor 23 and turning it off, which in turn turns off the transistor 24. When the AC source voltage again crosses below zero volts, the SCR 28 shuts off.

Figure 2B:
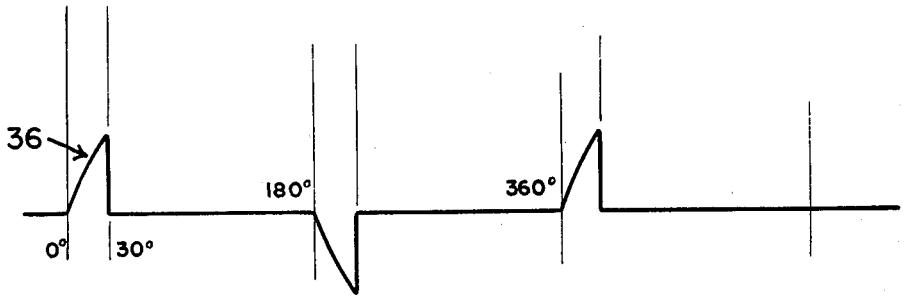

Referring to FIG. 2B, it can be seen that when the lamp 11 is on there is only a small time period during the AC waveform that voltage is available to the power supply circuit 20, the length of this time period being inversely proportional to the brightness of the lamp. It is a significant aspect of the present invention that during this short time period, the power supply circuit 20 conducts maximum current to the capacitor 26. Because of the diode 22, current is available only during the positive half cycles of the AC waveform. Thus, when the lamp 11 is on in the condition illustrated in FIG. 2B, the power supply circuit 20 passes current into the capacitor 26 only during the first 30° of the AC wave form and then the circuitry coasts during the ensuing 330° until the next cycle. During the interim, the voltage on capacitor 26 is used to power the rest of the circuitry of the module 10. Thus, the circuit passes charging current to the capacitor 26 during the 30° of each cycle that current is available to the transistor 24 until the capacitor 26 is fully charged, at which time power supply circuit 20 shuts itself off. Eventually, the voltage on the capacitor 26 will drop below its full-charge value, and when this occurs the transistors 23 and 24 will again be driven into saturation for recharging the capacitor 26 during the portion of each AC cycle in which voltage is available.

Thus, it can be seen that the power supply circuit 20 automatically turns itself on and off to supply charging current to the capacitor 26 as needed. Furthermore, it will be appreciated that the power supply circuit 20 is automatically synched to the AC line frequency, being responsive to the zero crossings thereof. Accordingly, this circuit can operate with any AC source irrespective of the frequency. The regulator 19 is used because the voltage that is being supplied to the processing unit 11 is continually changing. The capacitor 30 filters noise generated by the SCR 28 and the Zener diode 29 and prevents false triggering of the SCR 28.

It is a significant aspect of the present invention that the transistors 23 and 24 are either in a saturated condition or an off condition, as in a switching regulator, and they spend very little time in their active regions. Accordingly, there is very little heat generated by the transistors 23 and 24. This is significant since the module 10 is designed to be enclosed in a wall in place of a wall switch, in an environment which affords little potential for heat dissipation. Another important aspect of the present invention is the compact size of the module 10, as compared to passive regulators, which is also particularly advantageous in the wall-mounted application of the device.

In a constructional model of the power supply circuit 20 the resistor 21 is a 100 ohm resistor, the resistor 27 is a 27 Kohm resistor, the Zener diode 29 is a 24 volt diode, the capacitor 30 is 0.01 microfarads and the storage capacitor 26 is 470 microfarads. During the negative half cycle of the AC source voltage, and during the positive half cycle after the triac fires into conduction, the diode 25 prevents current from flowing back through the power supply circuit 20, and the diode 22 prevents reverse breakdown of the SCR 28.

From the foregoing, it can be seen that there has been provided an improved power supply circuit and a lamp dimming module incorporating same, wherein the power supply circuit is capable of operation with an intermittent AC source of any frequency.

We claim:

1. A line gated switching power supply capable of operation with an interrupted AC source, said power supply comprising a charge storage device adapted to be connected across an associated load, current value means including two transistors connected in a Darlington configuration having a collector terminal coupled to the AC source and an emitter terminal coupled to the charge storage device and a base terminal, said current valve means being adapted for operation between an open-circuit condition and a maximum-conduction condition for passing maximum current to said charge storage device for charging same, means connected to said base terminal for providing a control current to said current valve means sufficient to operate said current valve means in its maximum-conduction condition, and control means coupled to said current valve means and responsive when the voltage across said charge storage device exceeds a predetermined level for removing said control current from said current valve means thereby to cause said current valve means to shift to its open-circuit condition and terminate current flow to said charge storage device.

2. A line-gated switching power supply capable of operation with an interrupted AC source, said power supply comprising a charge storage device adapted to be connected across an associated load, current valve means having a control terminal and adapted for operation between an open-circuit condition and a maximum-conduction condition for passing maximum current, said current valve means being connected in circuit between the associated AC source and said charge storge device so that the voltage at said control terminal is proportional to the voltage across said charge storage device, means adapted to be connected to the AC source for providing a control current to said control terminal sufficient to operate said current valve means in its maximum-conduction condition for passing a maximum current to said charge storage device for charging same, a Zener diode having a cathode connected to said control terminal and having an anode, said Zener diode being responsive when the voltage at the cathode thereof exceeds a predetermined level for producing a gating current, and an SCR having its anode connected to said control terminal and having a gate terminal connected to the anode of said Zener diode for receiving said gating current, said SCR being responsive to said gating current for removing said control current from said current valve means thereby to cause said current valve means to shift to its open-circuit condition and terminate current flow to said charge storage device.

3. A line gated switching power supply capable of operation with an interrupted AC source, said power supply comprising a charge storage device adapted to be connected across an associated load, current valve means connected in circuit between the associated AC source and said charge storage device and adapted for operation between an open-circuit condition and a maximum-conduction condition for passing maximum current to said charge storage device for charging same, means for providing a control current to said current valve means sufficient to operate said current valve means in its maximum-conduction condition, and control means including an SCR coupled to said current valve means and a Zener diode connected across the anode and gate terminals of said SCR, said control means being responsive when the voltage across said charge storage device exceeds a predetermined level for removing said control current from said current valve means thereby to cause said current valve means to shift to its open-circuit condition and terminate current flow to said charge storage device.

4. A line-gated switching power supply capable of operation with an interrupted AC source, said power supply comprising a capacitor adapted to be connected across an associated load, transistor means having an input terminal adapted to be coupled to the associated AC source and an output terminal coupled to said capacitor and a control terminal, current limiting means connected between said input terminal and said control terminal for providing to the latter a control current sufficient to saturate said transistor means to provide maximum current flow therethrough to said capacitor for charging same, the voltage at said control terminal being proportional to the voltage across said capacitor, an SCR connected between said control terminal and ground and having a gating terminal, and a Zener diode having an anode connected to said gating terminal and a cathode connected to said control terminal, said Zener diode becoming conductive when the voltage at said control terminal exceeds a predetermined level for supplying a gating current to said gating terminal thereby to cause said SCR to remove said control current from said control terminal and turn off said transistor means for terminating the current flow to said capacitor.

5. The power supply of claim 4, wherein said transistor means comprises two transistors connected in a Darlington configuration having a collector terminal comprising said input terminal, an emitter terminal comprising said output terminal and a base terminal comprising said control terminal.

6. The power supply of claim 4, wherein said current limiting means comprises a resistor.

7. The power supply means of claim 4, and further including a unidirectional current means connected in series with said current limiting means for producing said control current only during the positive half cycles of the AC source voltage.

* * * * *

UNITED STATES PATENT AND TRADEMARK OFFICE

CERTIFICATE OF CORRECTION

PATENT NO. : 4,478,468

DATED : October 23, 1984

INVENTOR(S) : Erich W. Schoen and Lee D. Tice

It is certified that error appears in the above-identified patent and that said Letters Patent are hereby corrected as shown below:

Claim 1, column 5, line 43 "value" should be --valve--.

Claim 2, column 6, line 3, "storge" should be --storage--.

Signed and Sealed this

*Sixteenth* Day of *April 1985*

[SEAL]

*Attest:*

DONALD J. QUIGG

*Attesting Officer*

*Acting Commissioner of Patents and Trademarks*